US006918272B1

(12) United States Patent
Sanders

(10) Patent No.: US 6,918,272 B1
(45) **Date of Patent: *Jul. 19, 2005**

(54) NOTEBOOK COMPUTER SECURITY LEVER LOCK

(76) Inventor: Richard Sanders, 29 Harwich Cir., Westwood, MA (US) 02090

( * ) Notice: Subject to any disclaimer, the term of this patent is extended or adjusted under 35 U.S.C. 154(b) by 61 days.

This patent is subject to a terminal disclaimer.

(21) Appl. No.: 10/782,175

(22) Filed: Feb. 17, 2004

Related U.S. Application Data

(63) Continuation-in-part of application No. 10/457,331, filed on Jun. 10, 2003, now Pat. No. 6,708,535.

(51) Int. Cl.[7] ..... E05B 73/00
(52) U.S. Cl. ..... 70/58; 70/14
(58) Field of Search ..... 70/58, 49, 14, 70/18, 57, 57.1, 30; 248/551, 553

(56) References Cited

U.S. PATENT DOCUMENTS

| | | | | |
|---|---|---|---|---|
| 5,502,989 | A | 4/1996 | Murray, Jr. et al. | |
| 5,983,679 | A | 11/1999 | Reyes | |
| 6,401,502 | B1 * | 6/2002 | Yang | 70/30 |
| 6,523,373 | B1 * | 2/2003 | Su | 70/58 |
| 6,601,416 | B1 | 8/2003 | Sanders | |
| 6,619,080 | B1 * | 9/2003 | Yu | 70/58 |
| 6,662,602 | B1 * | 12/2003 | Carl | 70/58 |
| 6,672,117 | B2 * | 1/2004 | Yu | 70/58 |
| 6,708,535 | B1 * | 3/2004 | Sanders | 70/58 |
| 6,735,990 | B1 * | 5/2004 | Murray et al. | 70/58 |

* cited by examiner

*Primary Examiner*—John B. Walsh
(74) *Attorney, Agent, or Firm*—John P. McGonagle

(57) ABSTRACT

A lock with a cam action joined to a cylindrical assembly with a front portion adapted to being inserted into a computer chassis security slot. The cylindrical assembly front portion is comprised of two levers each terminating in a hook. The levers are pivotally attached to the cylindrical assembly and are pivoted within the security slot by the cam action of the lock.

7 Claims, 10 Drawing Sheets

NOTEBOOK COMPUTER SECURITY LEVER LOCK

RELATED U.S. APPLICATION DATA

This application is a continuation-in-part of U.S. patent application Ser. No. 10/457,331, filed Jun. 10, 2003 Now U.S. Pat. No. 6,708,535.

BACKGROUND OF THE INVENTION

This invention relates to security apparatus, and more particularly to apparatus for securing notebook computer equipment.

In recent years there has been a marked increase in the amount of computer equipment used in business and at home. Not only have the number of computers increased, but their size has become steadily smaller. Computer owners carry with them and use in areas with public access smaller computers such as laptop and notebook computers. Notebook computers only weigh several pounds or less and are easily concealed on the person or in a carry bag. Equipment items in this category generally have values from one to several thousands of dollars, and are easily marketed. Equipment such as this and their component parts are, therefore, attractive, lucrative and easy targets for thieves.

Many personal computers have a security slot in an external wall. Attempts to provide securing devices centered on this slot have been complicated. An example of this may be found in U.S. Pat. No. 5,502,989 (Reexamination Certificate B1 5,502,989), issued to W. R. Murray, Jr., et al. The Murray device, inter alia, provides a security device comprised of a housing with a slot engagement portion, said portion being rotatable between an unlocked position and a locked position, and a pin coupled through the housing and extending into the security slot member after said slot engagement member is in said locked position. The Murray device is specifically designed to engage a rectangular security slot. Another approach has been used in U.S. Pat. No. 5,983,679 issued to G. Reyes. The Reyes device uses a cam assembly with a single hook arm in conjunction with two prongs to engage with the predefined rectangular security slot.

A further problem with prior art locks, is the poor fit the locks make with the security slot. Many computer manufacturers have a different thickness in the wall with the security slot. Prior art locks have a set gripping width, i.e., the distance between the lock engagement end on one side of the security slot and the lock assembly itself on the other side of the security slot. Ideally, the gripping width should be as close to the width of the computer side wall as possible to prevent easy insertion of a prying device. The user must measure the wall thickness and shop for a lock with a gripping width as close to the wall thickness as possible.

Applicant addressed many of the above stated prior art problems with a notebook computer security lever locking assembly. See U.S. Pat. No. 6,601,416, issued to applicant. However, even though many of the prior art problems were solved, the use of externally protruding, fixed, parallel members, along with the patented elongated lever elements, limited the holding ability of the lock assembly and its ability to work with a wider scope of security slots having different configurations.

SUMMARY OF THE INVENTION

The present invention provides a relatively simple locking mechanism for preventing the theft of a small computer, such as a notebook computer. The locking mechanism of the present invention is adapted to fit all computers made by all manufacturers, which contain a security slot in their chassis, regardless of the configuration of the security slot.

To attain this, the present invention provides lock with a cam action joined to a cylindrical assembly with a front portion adapted to being inserted into a computer chassis security slot. The cylindrical assembly front portion is comprised of two levers each terminating in a hook. Each lever is pivotally attached to the cylindrical assembly and is pivoted in a scissors motion within the security slot by the cam action of the lock. The present invention replaces the complications inherent with the removable coupling pin of the Murray invention and eliminates the need for rotating the entire assembly in order to be positioned with a locked position. The present invention provides a sturdier locking configuration than the Reyes device. The present invention is capable of engaging a security slot having other than a rectangular configuration, a decided advantage over both the Murray and Reyes devices. The present inveniton also permits the use of larger hooking elements. The unique design of the present invention makes the present invention an ideal choice for the individual or organization that has a variety of computer brands to secure. A lockable cable engages the cylindrical assembly. The cable is secured to a fixed object to prevent the computer from being stolen or removed from a fixed location. In the present invention a variety of different type locking cables may be used.

Accordingly, it is an object of the present invention to provide a computer security locking apparatus for securing small computers, such as notebook computers, which have security slots in their chassis. It is additionally an object of the present invention to provide such an apparatus which is simple, economical, easy to use and quickly installed.

Another object of the invention is to provide such a security apparatus which is installed to said computer without modifying the computer chassis thereby removing the risk of contacting various components and circuitry therewithin.

It is another object of the present invention to provide a security apparatus which may use different types of anchoring cables.

It is an object of the invention to provide a security apparatus which does not require rotation between locked and unlocked positions.

It is still another object of the invention to provide a security apparatus which is activated by a cam lock action.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
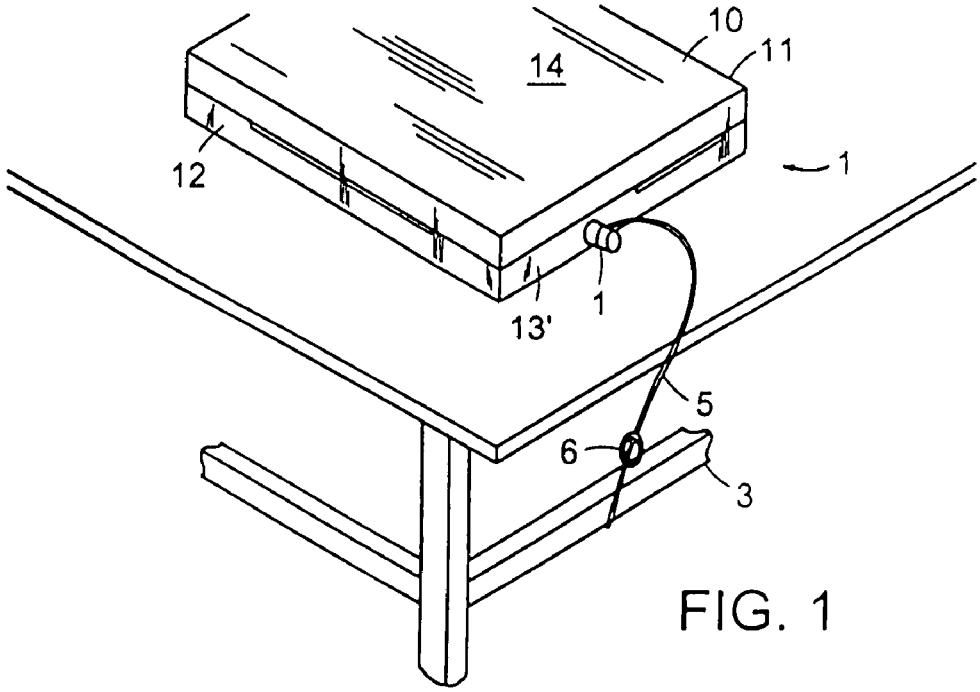
FIG. 1 is a perspective view of the invention, with a travel anchor cable, installed on a notebook computer, thereby securing the notebook computer to a table.

Referring to the drawings in detail wherein like elements are indicated by like numerals, there is shown an embodiment of the notebook computer security lever locking assembly 1 of the present invention. The invention 1 provides a cylindrical assembly 50 joined to a cam lock assembly 20 and an anchored locking cable 5. The cylindrical assembly 50 is comprised of a hollow cylindrical encasement element 60 within a cable lock housing 180. The encasement element 60 and cable lock housing 180 have concentric central axes which also define their longitudinal axes.

In the example shown, the computer 10 secured is a notebook computer. The computer 10 could be a smaller or a larger personal computer. The computer 10 has a generally rectangular configuration, with a front outer wall 11, rear outer wall 12, two outer side walls 13, a top 14, and a bottom 15. One of the computer sides 13' has an open security slot 16 formed therein. For exposition purposes, the security slot 16 has a generally rectangular configuration. The security slot long edges 17 define the security slot's longitudinal axis. In this embodiment, the security slot short edges 18 are parallel to the computer chassis top 14 and bottom 15. The locking cable 5 is inserted into the cable lock housing 180. The forward end 51 of the cylindrical assembly 50 is placed against the open security slot 16.

The cam lock assembly 20 is encased within the cylindrical assembly 50, said cam lock assembly 20 having two lever elements 80 protruding through the cylindrical assembly front end 51 into and through the open security slot 16. Manipulation of the cam lock assembly 20 locks the cylindrical assembly to the computer 10. The locking cable 5 is fastened to an appropriate secure object such as a table leg 3.

Figure 5:
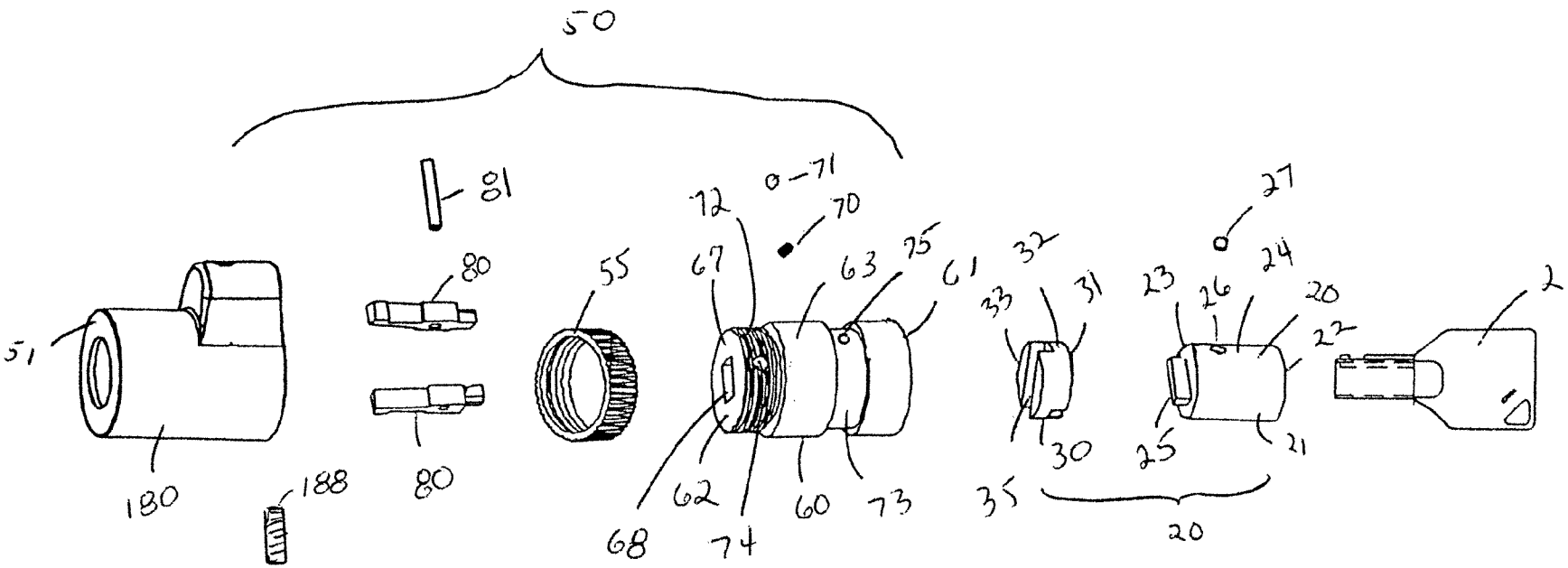
FIG. 5 is a close up, exploded view of the invention without an anchor cable.
Figure 6:
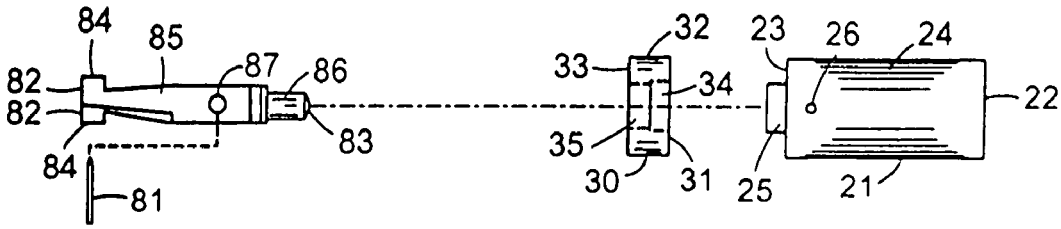
FIG. 6 is a side elevational view, partly exploded, of the invention lock assembly, cam cylinder and invention levers.
Figure 11:
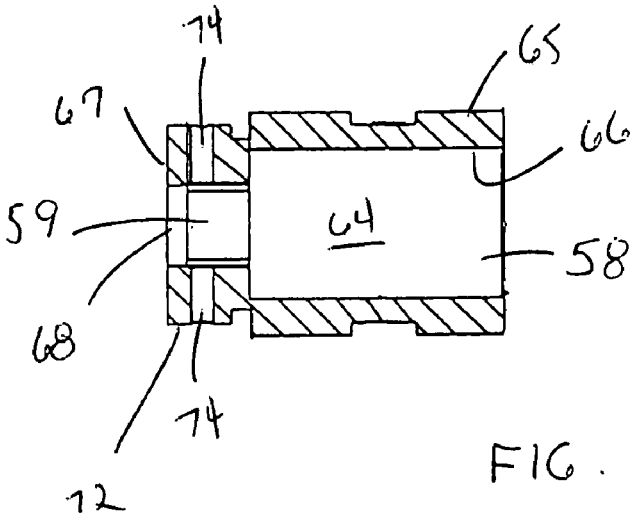
FIG. 11 is a side cross-sectional view of the encasement element.
Figure 12:
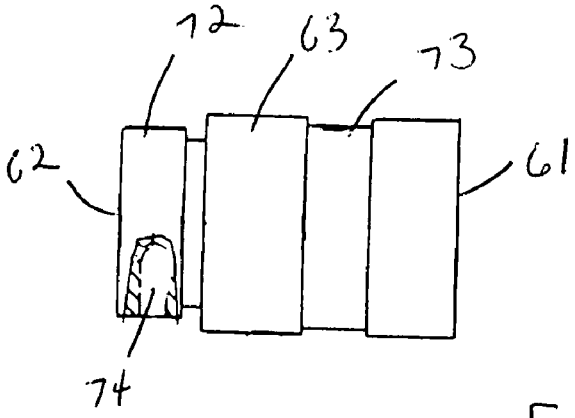
FIG. 12 is a side view of the encasement element.
Figure 13:
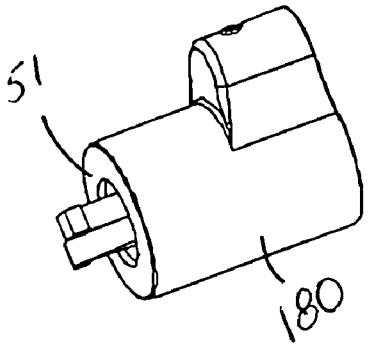
FIG. 13 is a perspective view of the assembled invention without an anchor cable.
Figure 14:
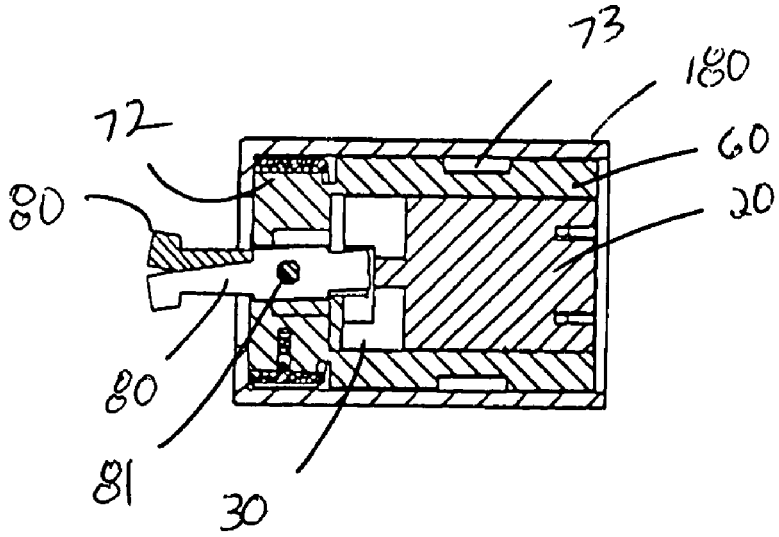
FIG. 14 is a side cross-sectional view of the assembled invention shown in FIG. 13.
Figure 15:
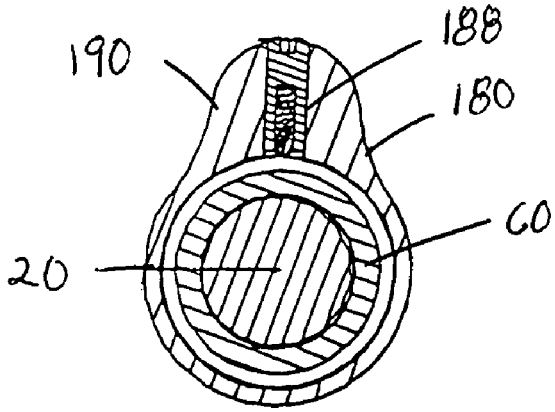
FIG. 15 is a rear sectional view of the assembled invention shown in FIG. 13.
Figure 16:
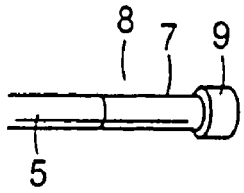
FIG. 16 is a side view of one end of the holding end of an anchor cable.
Figure 17:
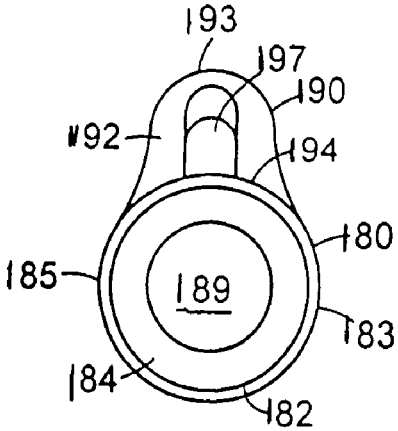
FIG. 17 is a rear view of the cable lock housing.
Figure 18:
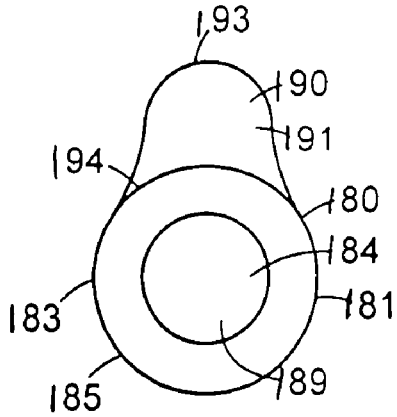
FIG. 18 is a front view of the cable lock housing.
Figure 19:
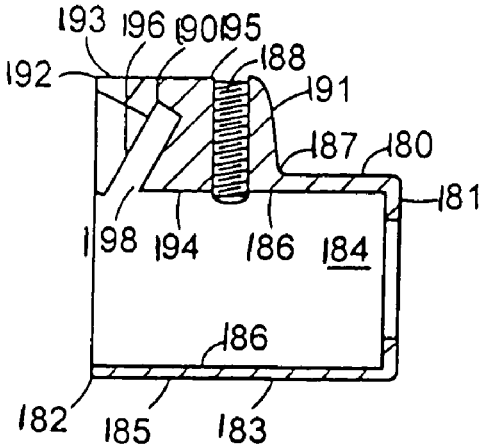
FIG. 19 is a cross section view of the cable lock housing.
Figure 20:
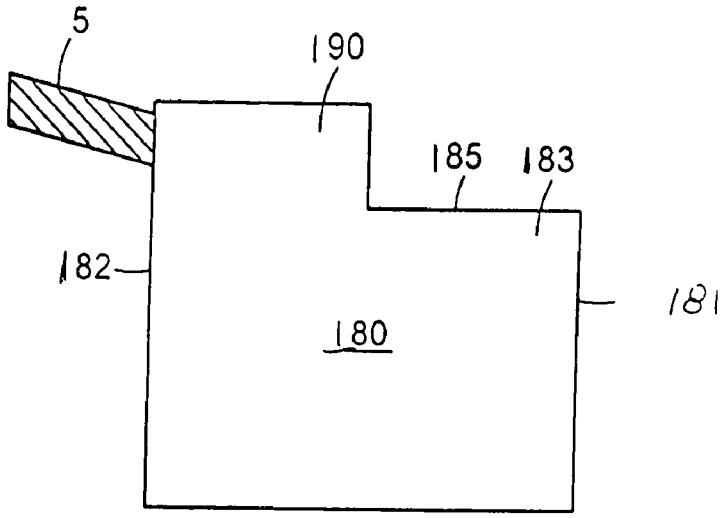
FIG. 20 is a side diagramatic side view of the cable lock housing.
Figure 21:
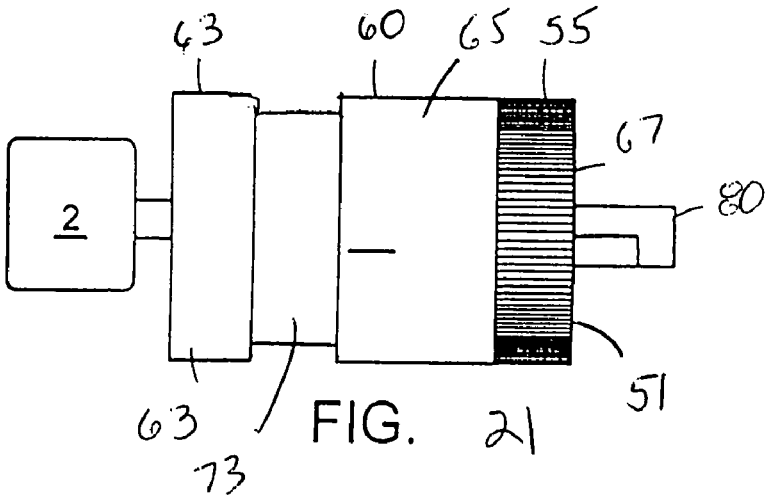
FIG. 21 is a diagramatic side view of the encasement element with lock assembly installed.
Figure 22:
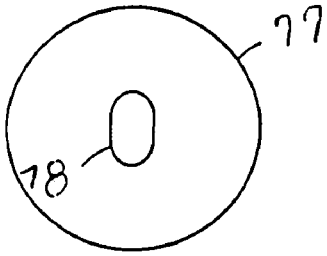
FIG. 22 is a front view of the adjustment spacer.
Figure 23:
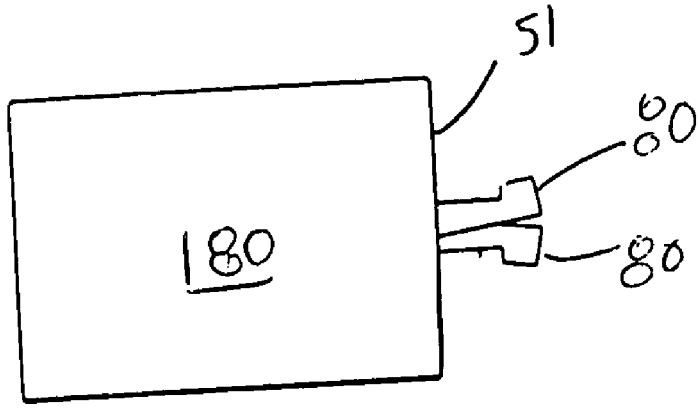
FIG. 23 is a side diagramatic view of the invention in a locked configuration.
Figure 24:
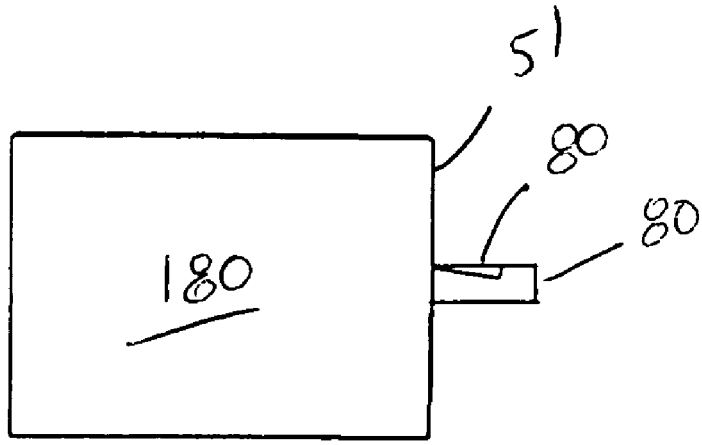
FIG. 24 is a side diagramatic view of the invention in an unlocked configuration.

The encasement element 60 has two ends, one termed the entry end 61 and the other termed the exit end 62. Referring more particularly to FIGS. 5, 11 and 12, the encasement element 60 is shaped and formed by a cylindrically curved, wall 63, preferably made from metal, extending from the entry end 61 to the exit end 62. The encasement element entry end 61 is open. The entry end 61, exit end 62 and wall 63 define a hollow interior 64. The wall 63 has an exterior surface 65 and an interior surface 66. The encasement element exit end 62 is closed with a flat end wall 67 having a small, central, elongated opening 68 therein. The encasement element 60 has a threaded radial channel 72 formed in the wall exterior surface 65 adjacent the encasement element exit end 62. The encasement element 60 also has a relatively shallow, smooth radial channel 73 formed in the wall exterior surface 65 rearward toward the encasement element entry end 61. The encasement element 60 has a small circular radial opening 75 formed in the smooth radial channel 73. There is another small circular radial opening 74 formed in the threaded radial channel 72, into which a small spring 70 and small ball 71 are inserted.

The encasement element interior 64 is formed into two sections, the entry end interior 58 and exit end interior 59. The exit end interior 59 is that portion of the encasement element defined by the threaded radial channel 72 and exit end 62. The diameter of the exit end interior 59 is less than the diameter of the entry end interior 58.

The encasement element 60 has two elongated lever elements 80 extending through the exit end opening 68 into the encasement element interior 64. The lever elements 80 are pivotally pinned in position by a pin 81 extending through the radial channel radial opening 74. Each lever 80 has a body 85 defined by rearward end 83 positioned within the encasement element interior 64 and a forward end 82 protruding out of the encasement element and terminating in a half crossbar 84 giving the lever 80 the general shape of an inverted "L". Each lever 80 has a longitudinal axis defined by the rearward end 83 and the forward end 82. The longitudinal axis of each lever 80 in an unlocked positioned is generally perpendicular to the plane of the end wall 67 and parallel to the cylindrical encasement element 60 longitudinal central axis. Each lever body 85 has a generally rectangular cross-section. Each lever rearward end 83 terminates in a cylindrical shaft 86 with a central axis coincident with the longitudinal central axis of the lever 80. Each lever body 85 has an aperture 87 formed through it at each lever's approximate longitudinal midpoint. Each lever 80 is adapted to pivotally rotate about the pin 81 positioned through the aperture 87, one lever pivoting in one direction and the other lever pivoting in an opposite direction, thereby forming a scissor crossing effect. The body 85 of each lever element 80 is substantially contained within the encasement element exit end interior 59. Each lever cylindrical shaft 86 protrudes into the encasement element entry end interior 58.

The encasement element 60 is further comprised of a ring 55 having an outer surface 56 and a threaded inner surface 57, said ring 55 adapted to threadingly engage the encasement element threaded channel 72. The spring 70 and ball 71 are adapted to hold the ring 55 in place. The ring 55 has a radial outer diameter equal to the radial outer diameter of encasement exterior surface 65. The ring outer surface 56 is nominally smooth. However, for improved gripping purposes the outer surface 56 may be knurled or otherwise ridged or channeled for gripping purposes.

The cylindrical encasement element 60 is housed within a cable lock housing 180. An anchored locking cable 5 is removably attached to the cable lock housing 180. The cable lock housing 180 has an enclosed front end 181 from which a cylindrical side wall 183 extends to an open rear end 182, said front end 181 and rear end 182 defining a cable lock housing longitudinal axis, said front end 181, side wall 183 and rear end 182 defining a cable lock housing hollow interior 184, said cable lock housing 180 being generally cylindrical in shape. The cable lock housing front end 181 has a generally circular aperture 189 formed centrally therein. The side wall 183 has a smooth exterior surface 185 and a smooth interior surface 186.

The side wall exterior surface 185 has a rounded, radially protruding, elongated element 190 formed thereon extending longitudinally from the housing rear end 182 to an approximate housing longitudinal midpoint 187. The protruding element 190 has a closed forward end 191, an open rearward end 192, a radially rounded top 193 and a bottom 194 formed from the housing side wall 183, said forward end 191 and rearward end 192 defining a protruding element longitudinal axis, said protruding element longitudinal axis being parallel to the cable lock housing longitudinal axis. The forward end 191, rearward end 192, top 193 and bottom 194 define a protruding element interior 197. The protruding element 190 is divided longitudinally into a forward section 195 and a rearward section 196. The interior 197 portion of the protruding element forward section 195 is solid. However, an inwardly protruding spring-loaded ball 188 is embedded in the forward section protruding element bottom 194 projecting inwardly toward a cable lock housing central longitudinal axis. The spring-loaded ball 188 is adapted to engage the encasement element exterior surface smooth radial channel 73.

The interior 197 portion of the protruding element rearward section 196 is hollow. The bottom 194 portion of the protruding element rearward section 196 is open. A radial channel 198 is formed within the protruding element rearward section interior 197 portion adjacent the protruding element forward section 195 interior 197 portion. The radial channel 198 has a diameter greater than the diameter of the open rearward end 192 and a bottom 194 opening greater than the bottom 194 opening of the open rear end 192.

Figure 2:
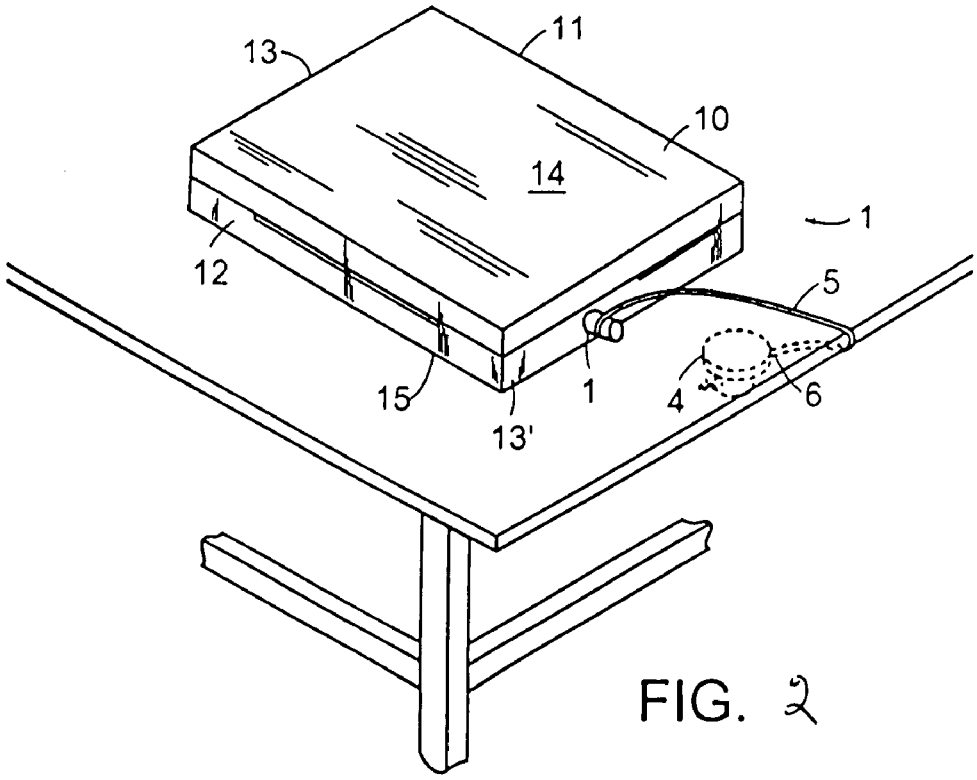
FIG. 2 is a perspective view of the invention, with an office anchor cable, installed on a notebook computer, thereby securing the notebook computer to a work surface.
Figure 3:
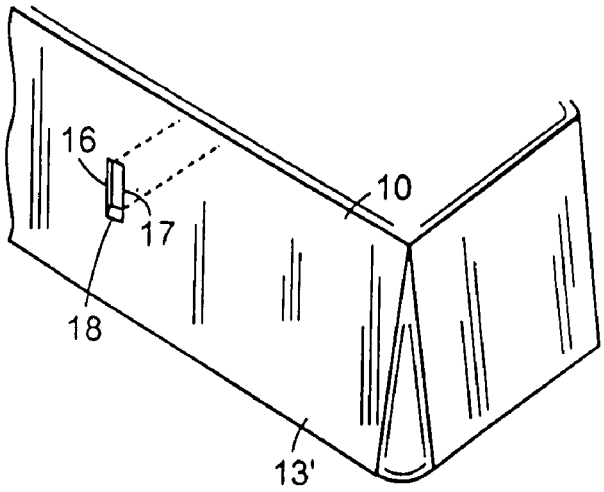
FIG. 3 is a close up perspective view of a computer open security slot.
Figure 4:
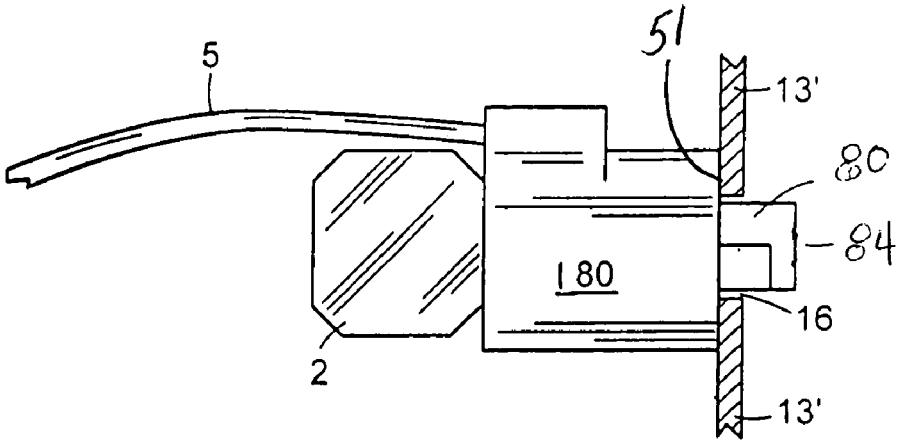
FIG. 4 is a side view of the invention installed in a computer open security slot.

The cable lock housing 180 and encasement element exterior surface 65 combination is used in conjunction with an anchored locking cable 5. The locking cable 5 has two ends, an anchored end 6 and a holding end 7. As may be seen in FIGS. 1A, 1B and 2, the cable anchored end 6 may terminate in a simple slip knot and wrapped around a secure object such as a table leg 3. The cable anchored end 6 may also be attached to a special adaptor 4 glued to a secure object such as the underside of a desk. Any number of anchor cables having different anchored ends 6 may be used with the present invention. The holding end 7 of the cable is comprised of a cylindrical shank 8 terminating in a disk-like protrusion 9 having a diameter greater than said shank 8. The anchor cable 5 is adapted to being connected to the cable lock housing 180 by sliding the anchor cable disk 9 into the protruding element radial channel 198 through the protruding element rearward section open bottom 194 and threading the cable shank 8 through the protruding element rearward end 192. The encasement element 60 is then slid into the cable lock housing interior 184 and the cable 5 is secured within the protruding element radial channel 198.

As stated above the cylindrical assembly 50 is joined to a cam lock assembly 20. The lock assembly 20 is comprised of a lock mechanism 21, and a cam unit 30. The lock mechanism 21 is a conventional key 2 operated lock with internal indents (not shown) to hold the key rotational turn at either 0° or 90°. The lock mechanism 21 has a rear portion 22 adapted to receive a key 2, a forward portion 23 and a cylindrical body 24 defined by said rear and forward portions 22, 23. The lock mechanism 21 has a circular opening 26 formed in its wall 63. The opening 26 is adapted to receive a pin 27. The longitudinal axis of the lock mechanism 21 is defined from the rear portion 22 to the forward portion 23. The lock mechanism central longitudinal axis is concentric with the central longitudinal axis of the cylindrical assembly 50. The forward portion 23 has a central, generally rectangular block element 25 protruding outward therefrom in a forward direction along the central longitudinal axis of the lock mechanism 21. The lock mechanism 21 is so constructed that movement of the key 900 causes a direct corresponding turn of the block element 25.

The lock mechanism forward block element 25 fits into the cam unit 30. The cam unit 30 has a rear wall 31 from which cylindrical side walls 32 extend horizontally forward, said cam unit 30 being generally cylindrical in shape, the longitudinal axis of said cam unit 30 being generally perpendicular to the rear wall 31 of said cam unit 30, said cam unit 30 having a front wall 33 connected to said cylindrical side walls 32, said front wall 33 being generally parallel to said rear wall 31. The cam unit rear wall 31 has a generally rectangular, central aperture 34 formed therein, said aperture 34 adapted to receive the lock mechanism forward block element 25. The cam unit front wall 33 has an elongated central slot 35 formed therein. The slot 35 and aperture 34 each have a longitudinal axis perpendicular to the cam unit 30 longitudinal axis.

The external diameters of the lock mechanism 21 and cam unit 30 are approximately the same. The external diameters of the lock mechanism 21 and cam unit 30 are slightly less than the diameter of the encasement element entry end interior 58, but greater than the diameter of the encasement element exit end interior 59. The lock assembly 20 is adapted to fit substantially into the encasement element entry end interior 58, cam unit front wall 33 first. The lever element cylindrical shafts 86 fit into the cam unit front wall slot 35. The lock mechanism body opening 26 is aligned with the encasement element circular opening 75. A pin 27 engages the two openings 26, 75 and thereby holds the cam lock assembly 20 in place within the encasement element interior 64.

In operation, the anchor cable 5 is installed as described above. The cylindrical element forward end 51, comprising the lever element forward ends 82, are inserted into computer open security slot 16. The key 2 is then turned 90°. The lock mechanism forward block element 25 will turn 90°, thereby turning the cam unit 30 90°. The cam unit slot 35 will thereby turn, causing a "camming" action on the lever element cylindrical shafts 86 thereby causing the lever bodies 85 to pivot in opposite directions. This results in the one lever element forward end 82 moving toward a security slot edge 17 and the other lever element forward end 82 moving toward the opposite security slot edge 17'.

Figure 7A:
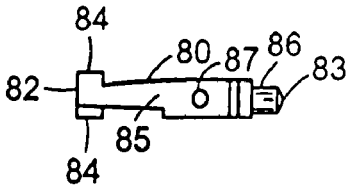
FIG. 7A is a front view of the cam cylinder force field with levers in an unlocked configuration.
Figures 1, 7A:
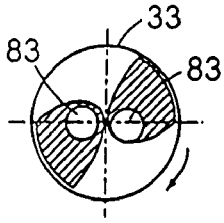
Figure 8A:
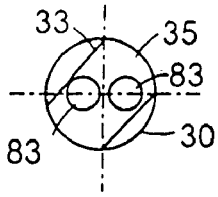
FIG. 8A is a front view of the cam cylinder with lever rearward ends in an unlocked position.
Figure 7B:
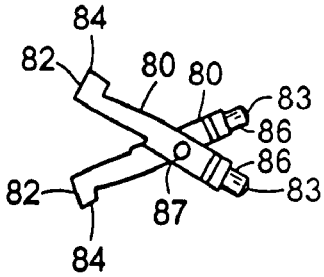
FIG. 7B is a front view of the cam cylinder force field with levers in a locked configuration.
Figures 1, 7B:
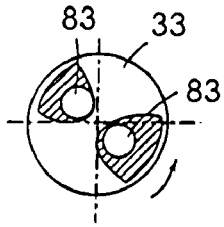
Figure 8B:
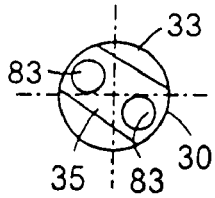
FIG. 8B is a front view of the cam cylinder with lever rearward ends in a locked position.
Figure 8C:
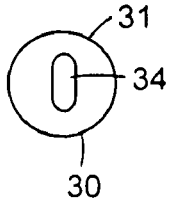
FIG. 8C is a rear view of the cam cylinder.
Figure 9:
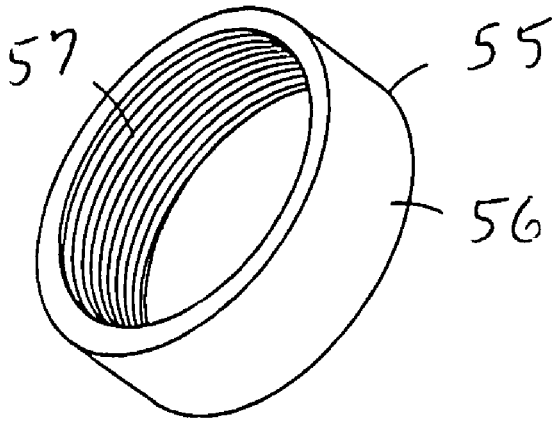
FIG. 9 is a perspective view of a ring used on the encasement element.
Figure 10:
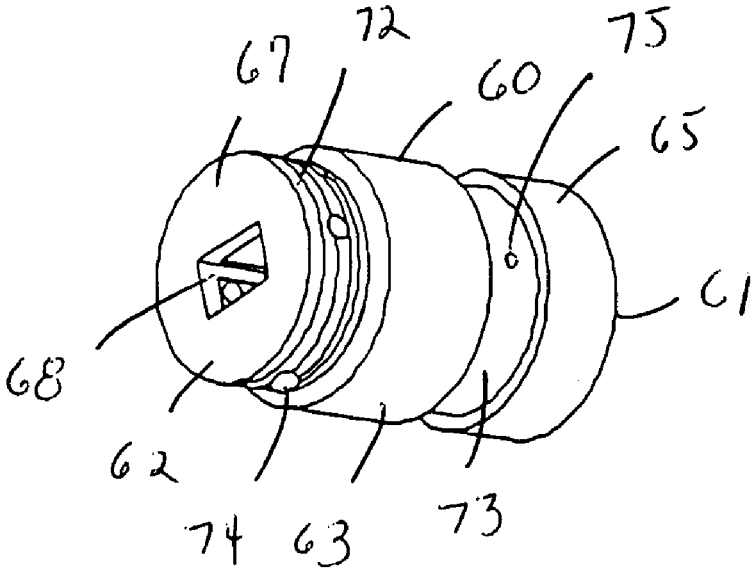
FIG. 10 is a perspective view of the encasement element.

FIGS. 7A and 7B illustrate the force exerted by the cam unit front slot 35 on the lever rearward ends 83, while FIGS. 8A and 8B illustrate the actual corresponding movement of the slot 35 against the lever rearward ends 83. FIGS. 7A and 8A show the cam unit 30 positioned so that the levers 80 are generally parallel and in an "unlocked" mode. FIGS. 7B and 8B illustrate the cam unit 30 being turned 90° to the "locked" mode, and the consequent affect on the lever rearward ends 83 causing the levers 80 to scissor about the pin 81. The lever element half cross bars 84 will engage each of the edges 17 or 17'.

Different computers may have different thicknesses for the wall 13' containing the security slot 16. The present invention provides a means for adjusting the gripping width of the present invention lock assembly 1. The gripping width is defined as the distance between the underside of the lever cross bars 84 and the cable lock housing front end 181. Ideally, the gripping width should be as close to the width of the computer side wall 13' as possible. Adjustment is provided with the ring 55 in threading engagement with the encasement element threaded channel 72. By manipulating this ring 55 the overall longitudinal length of the encasement element 60 may be increased or decreased changing the extension of the lever elements 80 from the encasement element end wall 67 and through the cable lock housing front end 181 into the security slot 16, thereby affecting the gripping width of the lock assembly 1.

An adjustment spacer 77 is also provided. The adjustment spacer 77 is a round, flat piece with an elongated aperture 78 formed centrally therein. The spacer 77 has a thickness equal to the thickness of the housing front end 181. encasement element 60 with cam lock assembly 20 may be fitted to a computer 10 by removing the cable lock housing 180 and placing the spacer 75 over the protruding lever elements 80. The spacer 77 replaces the cable lock housing 180. The encasement element 60 with cam lock assembly 20 and spacer 77 are fitted into the security slot 16. After a desired adjustment is made by manipulation of the ring 55, the spacer 77 is removed and the cable lock housing 180 is fitted over the encasement element 60 for installation on the computer 10.

It is understood that the above-described embodiment is merely illustrative of the application. Other embodiments may be readily devised by those skilled in the art which will embody the principles of the invention and fall within the spirit and scope thereof.

I claim:

1. A security lever lock assembly adapted to operate in combination with a computer having a front wall, rear wall, two side walls, a top wall, and a bottom wall, one of said walls having an open security slot formed therein, comprising:

a cylindrical assembly with a front portion adapted to being inserted into said security slot, said front portion being comprised of two elongated lever elements, each said lever element terminating in a half crossbar, each said lever element being pivotally attached to the cylindrical assembly, said lever elements being adapted to being pivoted in a scissors motion within the security slot by a camming action of a cam lock;

an anchored locking cable removably joined to said cylindrical assembly;

a cam lock assembly joined to said cylindrical assembly, wherein said cam lock assembly is comprised of:

a key operated lock mechanism with internal indents adapted to hold a key rotational turn at either 0° or 90°, said lock mechanism having a rear portion adapted to receive the key, a forward portion and a cylindrical body defined by said rear and forward portions, said lock mechanism having a circular opening formed in its wall, said opening adapted to receive a pin, said rear portion and forward portion defining a lock mechanism longitudinal axis, said lock mechanism longitudinal axis being concentric with a central longitudinal axis of the cylindrical assembly, said lock mechanism forward portion having a central, generally rectangular block element protruding outward therefrom in a forward direction along a forward central longitudinal axis of the lock mechanism, said lock mechanism being adapted to cause a radial turn of the block element with a radial movement the key 90°; and a cam unit adapted to receive the block element, said cam unit having a rear wall from which cylindrical side walls extend horizontally forward, said cam unit being generally cylindrical in shape, said cam unit having a longitudinal axis generally perpendicular to the rear wall, said cam unit having a front wall connected to said cylindrical side walls, said front wall being generally parallel to said rear wall, said cam unit rear wall having a generally rectangular, central aperture formed therein, said aperture adapted to receive the lock mechanism forward block element, said cam unit front wall having an elongated central slot formed therein, said slot and aperture each have a longitudinal axis perpendicular to the cam unit longitudinal axis.

2. A security lever lock assembly as recited in claim 1, wherein said cylindrical assembly is comprised of:

a hollow cylindrical encasement element having two ends, an open entry end and an exit end, and a cylindrically curved wall extending from the entry end to the exit end, said entry end, exit end and wall defining a hollow interior, said wall having an exterior surface and an interior surface, said exit end being closed with a flat end wall having a small, central, elongated opening therein, said encasement element having a threaded radial channel formed in the wall exterior surface adjacent the encasement element exit end and a shallow, smooth radial channel formed in the wall exterior surface rearward toward the encasement element entry end, said encasement element having a circular radial opening formed in the smooth radial channel, said encasement element having another circular radial opening formed in the threaded radial channel into which a small spring and small ball are inserted, said encasement element interior being formed into two sections, an entry end interior and an exit end interior, said exit end interior being that portion of the encasement element defined by the threaded radial channel and exit end, said exit end interior having a diameter less than an entry end interior diameter, said encasement element having said two elongated lever elements extending through the exit end opening into the encasement element interior, said lever elements being pivotally pinned in position by a pin extending through the opening in the threaded radial channel, each said lever having a body defined by rearward end positioned within the encasement element interior and a forward end protruding out of the encasement element and terminating in a half crossbar giving the lever the general shape of an inverted "L", each said lever having a longitudinal axis defined by the rearward end and the forward end, said longitudinal axis of each lever in an unlocked positioned being generally perpendicular to the plane of the end wall and parallel to the cylindrical encasement element longitudinal central axis, each said lever body having a generally rectangular cross-section, each lever rearward end terminating in a cylindrical shaft with a central axis coincident with the longitudinal central axis of the lever, each lever body having an aperture formed through it at each lever's approximate longitudinal midpoint, each said lever being adapted to pivotally rotate about the pin positioned through the aperture, one lever pivoting in one direction and the other lever pivoting in an opposite direction, thereby forming a scissor crossing effect, the body of each lever element being substantially contained within the encasement element exit end interior, each lever cylindrical shaft protruding into the encasement element entry end interior; and a cable lock housing positioned over said encasement element;

wherein said encasement element and cable lock housing have concentric central axes defining longitudinal axes for each element.

3. A security lever lock assembly as recited in claim 2, wherein:

the lock mechanism and cam unit each have an external diameter of approximately the same dimension, said external diameters of the lock mechanism and cam unit being slightly less than the diameter of the encasement element entry end interior and greater than the diameter of the encasement element exit end interior, said lock assembly being adapted to fit substantially into the encasement element entry end interior, cam unit front wall first, each said lever element cylindrical shaft fitted into the cam unit front wall slot, said lock mechanism body opening being aligned with the encasement element circular opening.

4. A security lever lock assembly as recited in claim 3, wherein:

the cable lock housing has an enclosed front end from which a cylindrical side wall extends to an open rear end, said front end and rear end defining a cable lock housing longitudinal axis, said front end, side wall and rear end defining a cable lock housing hollow interior, said cable lock housing body being generally cylindrical in shape, said cable lock housing front end having a generally circular aperture formed centrally therein, said side wall having an exterior surface and an interior surface, said side wall exterior surface having a rounded, radially protruding, elongated element formed thereon extending longitudinally from the housing rear end to an approximate housing longitudinal midpoint, said protruding, elongated element having a closed forward end, an open rearward end, a radially rounded top and a bottom formed from the housing side wall, said forward end and rearward end defining a protruding element longitudinal axis, said protruding element longitudinal axis being parallel to the cable lock housing longitudinal axis, said forward end, rearward end, top and bottom defining a protruding element interior, said protruding element being divided longitudinally into a forward section and a rearward section, said forward section having an inwardly protruding spring-loaded ball embedded in the forward section protruding element bottom projecting inwardly toward a cable lock housing central longitudinal axis, said protruding spring-loaded ball adapted to engage the encasement element smooth radial channel, said protruding element rearward section having a hollow interior, said bottom portion of the protruding element rearward section being open, said protruding element rearward section interior having a radial channel formed within a portion adjacent the protruding element forward section interior portion, said radial channel having a diameter greater than a diameter of the open rearward end, and a bottom opening greater than a bottom opening of the open rear end.

5. A security lever lock assembly as recited in claim 4, wherein:

the anchored locking cable has two ends, an anchored end and a holding end, said cable holding end being comprised of a cylindrical shank terminating in a disk having a diameter greater than said shank, said anchored locking cable adapted to be connected to the cable lock housing by insertion of the anchor cable disk into the protruding element radial channel through the protruding element rearward section open bottom and threading the cable shank through the protruding element rearward end, said encasement element inserted into the cable lock housing interior securing the cable within the protruding element radial channel.

6. A security lever lock assembly as recited in claim 5, wherein:

the encasement element is further comprised of a ring having an outer surface and a threaded inner surface, said ring being adapted to threadingly engage the encasement element threaded channel, said ring having a radial outer diameter equal to the radial outer diameter of encasement exterior surface.

7. A security lever lock assembly as recited in claim 6, further comprising:

an adjustment spacer comprised of a round, flat piece with an elongated aperture formed centrally therein, said spacer having a thickness equal to a thickness of the housing front end, said adjustment spacer adapted to being fitted over the protruding lever elements in place of the cable lock housing.

* * * * *